United States Patent [19]

Greck

[11] Patent Number: 4,706,836

[45] Date of Patent: Nov. 17, 1987

[54] LEAK-RESISTANT DRUM SEALS

[75] Inventor: Eugene Greck, Westfield, N.J.

[73] Assignee: Allen-Stevens Drum Accessories Corp., Somerset, N.J.

[21] Appl. No.: 6,126

[22] Filed: Jan. 23, 1987

[51] Int. Cl.[4] ..... B65D 51/16; B65D 51/18

[52] U.S. Cl. ..... 220/256; 220/288; 220/257

[58] Field of Search ..... 220/256, 257, 288

[56] References Cited

U.S. PATENT DOCUMENTS

| | | | |
|---|---|---|---|
| 3,946,894 | 3/1976 | Simkus | 220/256 |
| 4,004,709 | 1/1977 | Simkus | 220/288 |
| 4,136,796 | 1/1979 | Dubois et al. | 220/256 |
| 4,316,318 | 2/1982 | Mineo | 220/288 |

*Primary Examiner*—George T. Hall

*Attorney, Agent, or Firm*—Kirschstein, Kirschstein, Ottinger & Israel

[57] ABSTRACT

Leaks of hazardous materials that are toxic by inhalation are resisted from shipping drums of substantial capacity by an improved drum seal which resists rotation of a plug relative to an overcap which is locked onto the plug.

11 Claims, 6 Drawing Figures

LEAK-RESISTANT DRUM SEALS

BACKGROUND OF THE INVENTION

1. Field of the Invention

This invention generally relates to shipping drums and, more particularly, to seals for resisting leakage of materials from such drums, particularly during transport.

2. Description of Related Art

It is well known to store and transport materials, particularly of the hazardous type that are toxic by inhalation, in shipping drums of substantial capacity, e.g. on the order of 55 gallons. To minimize the risk of leakage associated with the transport of such toxic materials, the drums are typically provided with threaded closures that are adequately torqued and tightened. Nevertheless, no matter how much tightened, the closure has a tendency to back up and loosen, at least to a certain extent, due to vibrations and impact forces commonly experienced during shipping of the toxic materials. Where materials of ever-increasing toxicity are concerned, even an ever-so-slight deterioration of integrity of the drum seal is not acceptable and must be prevented.

SUMMARY OF THE INVENTION

1. Objects of the Invention

It is a general object of this invention to overcome the drawbacks associated with threaded closures of the prior art.

It is another object of this invention to provide a highly reliable drum seal for resisting leaks of materials during shipping.

Still another object of this invention is to provide a drum seal whose integrity is not compromised by vibrations and/or impact forces commonly experienced during transport.

2. Features of the Invention

In keeping with these objects, and others which will become apparent hereinafter, one feature of this invention resides, briefly stated, in a drum seal for resisting leaks of materials, particularly, but not necessarily, hazardous materials that are toxic by inhalation from a shipping drum, especially a drum of substantial capacity, i.e. on the order of 55 gallons. The drum seal advantageously comprises a drum head having an annular neck surrounding a longitudinal axis. The drum seal further comprises a base having an interiorly-threaded portion mounted within, and axially extending along, the neck. The drum seal additionally comprises a plug having an exteriorly-threaded portion mounted within, and threadedly engaging, the interiorly-threaded base portion. The plug has a radially-extending collar which is located axially adjacent the exteriorly-threaded portion.

In addition, the drum seal includes a seal mounted between, and sealingly engaging, the collar and the base to resist leakage of toxic hazardous materials past the threadedly-engaged interiorly- and exteriorly-threaded portions. An overcap, also known as a capseal, is mounted on the drum head, and confines the base, plug and seal.

In accordance with this invention, means are provided for resisting rotation of the plug about the axis during shipping of the drum. Such resisting means includes locking means on the overcap, and co-acting means on the collar. The co-acting means cooperatively lockingly engages the locking means to resist rotation of the plug relative to the overcap. The resisting means thus prevents the threaded plug from tending to back up and loosen due to vibrations and impact forces commonly experienced during transport of the shipping drum.

In accordance with a first embodiment of the drum seal, the drum head is provided with a polygonal recess, and the base is provided with a polygonal flange of complementary contour to, and seated within, the polygonal recess. The neck has an axially-extending end region which is received in a fold formed by a folded lip on the base.

The overcap in the first embodiment has a cap portion mounted over the plug, and a depending skirt portion crimped onto the neck. The cap portion has a serrated annular surface overlying, and lockingly engaging, another serrated annular surface on the collar.

In accordance with a second embodiment of this invention, the drum head is provided with a circular recess, and the base is provided with a circular flange of complementary contour to, and seated within, the circular recess. The neck has a radially-extending end region, and the base has a radially-extending lip juxtaposed with said neck end region. An auxiliary seal is mounted between, and sealingly engages, the lip and end neck region.

Also, in accordance with this second embodiment, the overcap has a cap portion mounted over the plug, and a depending skirt portion crimped onto the neck. The cap portion is advantageously formed with a polygonal cylindrical wall, and the collar is provided with a polygonal outer wall of complementary contour to, and lockingly engaging, the polygonal wall of the cap portion.

No matter whether rotation of the plug is resisted by mutually-opposing and lockingly-engaging serrated annular surfaces, or polygonal walls, the plug is affirmatively prevented from rotating relative to the overcap, thereby providing an uncompromising high-integrity seal for resisting leakage of toxic hazardous materials.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENTS

Figure 3:
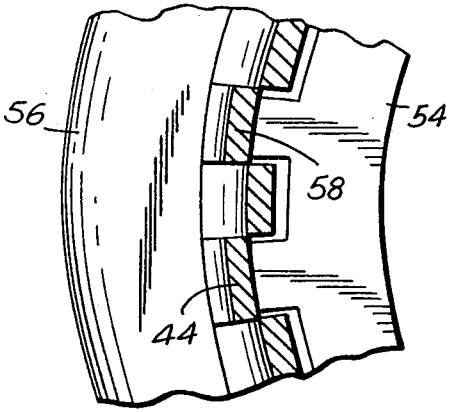
FIG. 3 is a greatly enlarged sectional view taken along line 3—3 of FIG. 2.
Figure 1:
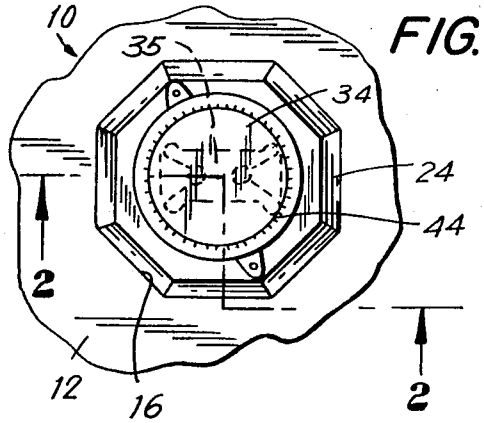
FIG. 1 is a broken-away top view of a first embodiment of a drum seal according to this invention.
Figure 2:
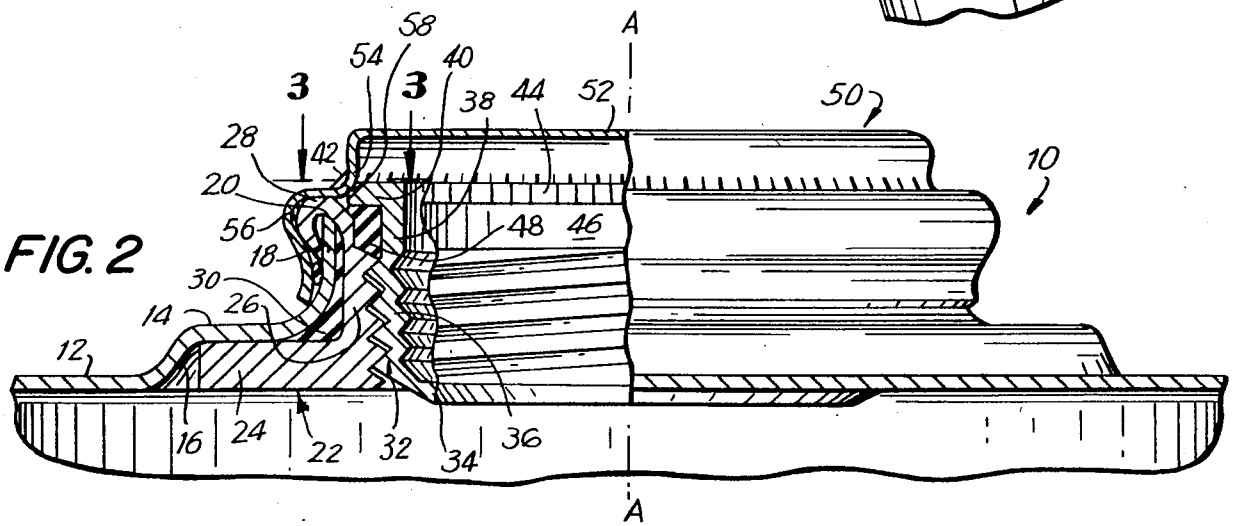
FIG. 2 is an enlarged sectional view taken along line 2—2 of FIG. 1.

Referring now to the drawings and, more particularly, to FIGS. 1–3, reference numeral 10 generally identifies a first embodiment of a drum seal which comprises a drum head 12 shown in broken-away view, and constituting a circular end wall of a barrel drum, particularly one of substantial capacity, e.g. 55 gallons. The drum itself may be of all-steel construction. Alternatively, the drum may be a polyethylene/fiberglass reinforced plastic, dual-laminated composite drum. In another variant, the drum may be an all-polyethylene drum (rotationally molded of cross-link or linear low-density polyethylene resin).

The drum head 12 has an offset wall 14 bounding a polygonal recess 16, as well as a cylindrical neck 18 which extends axially along a longitudinal axis A—A. The neck 18 terminates in a circular open end region or mouth 20.

A base 22 has a polygonal flange 24 of complementary contour to, and seated within, the recess 16. The base 22 also has an interiorly-threaded cylindrical sleeve portion 26, and a folded or bent lip 28 forming a fold in which the mouth 20 is closely received. A seal 30 of rubber, plastic or other sealing material is mounted between, and sealingly engages, the exterior of the threaded sleeve portion 26 and the interior of the neck 18.

A plug 32 has a closed wall 34 spanning a hollow passage extending axially through the threaded sleeve portion 26. The plug 32 also has an exteriorly-threaded cylindrical portion 36 threadedly engaging the interiorly-threaded sleeve portion 26. The plug 32 further has an axially-extending non-threaded tubular portion 38, and a radially-extending annular collar 40 which is axially adjacent to the threaded cylindrical portion 36. The collar 40 has an outer annular surface 42 which is formed with a plurality of serrations 44 or analogous roughening. The plug 32 is provided with an insert 35 (see FIG. 1) in interior space 46 bounded by threaded portion 36. The insert 35 enables the plug 32 to be adequately torqued so that the exteriorly- and interiorly-threaded portions will tightly engage each other. A seal 48 of rubber, plastic or analogous sealing material is mounted between, and sealingly engages, the collar 40 and the tubular portion 38, on the one hand, and the lip 20, on the other hand, so as to not only resist outward leakage of the hazardous materials past the threadedly-engaged exteriorly- and interiorly-threaded portions 36, 26, but also to resist inward flow of ambient air into the drum.

An overcap 50, also known as a capseal, is mounted on the drum head 12, and confines the base 22, the plug 32 and the seal 48. The overcap 50 has a top wall 52 overlying and closing the interior space 46, a cylindrical cap portion 54 extending downwardly from the top wall 52, and a depending annular skirt portion 56 crimped onto the neck 14. The cap portion 54 is provided with a plurality of serrations 58 or analogous roughenings.

As best shown in FIG. 3, the serrations 58 on the cap portion 54 of the overcap 50 serve as locking means. The serrations 44 on the collar 40 of the plug 32 serve as co-acting means which cooperatively lockingly engage the serrations 58. The locking interengagement between the serrations 58 and 44 act to resist rotation of the plug relative to the overcap about the axis A—A, and affirmatively prevent such rotation during shipping of the drum, particularly when impact forces and vibrations act on the same.

Figure 6:
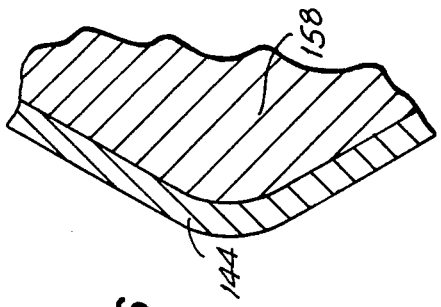
FIG. 6 is a greatly enlarged sectional view taken along line 6—6 of FIG. 5.
Figure 4:
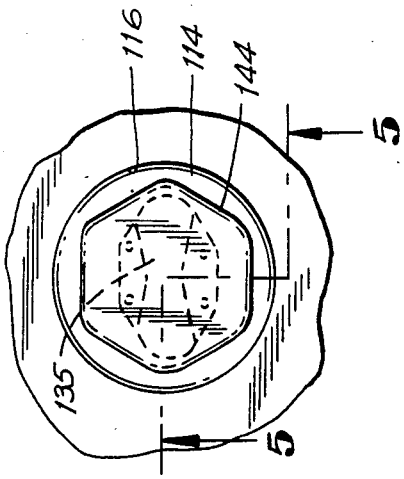
FIG. 4 is a broken-away top view of a second embodiment of a drum seal according to this invention.
Figure 5:
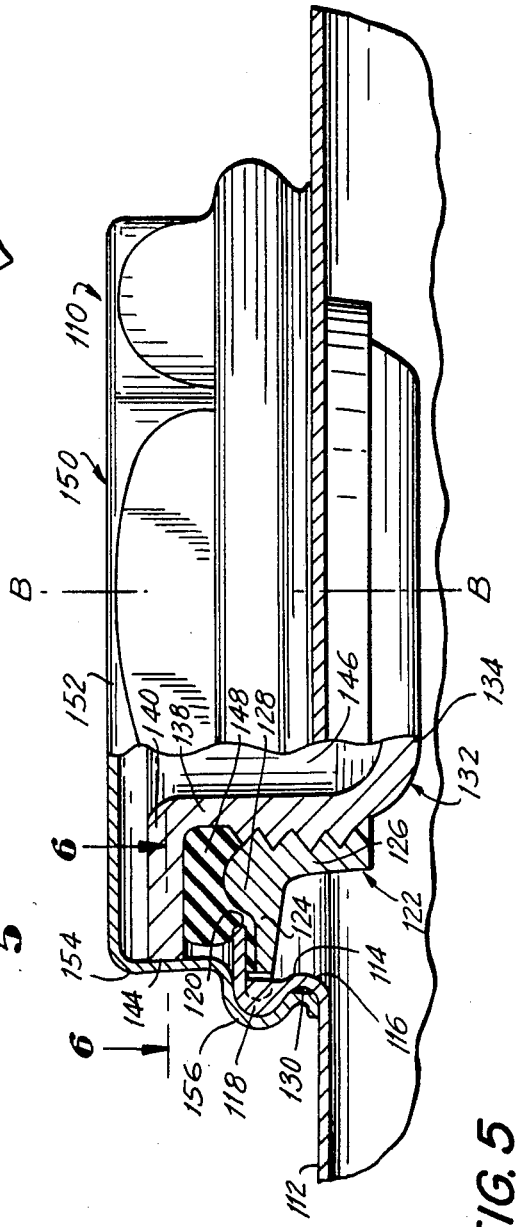
FIG. 5 is an enlarged sectional view taken along line 5—5 of FIG. 4.

Turning now to FIGS. 4–6, reference numeral 110 generally identifies a second embodiment of a drum seal comprising a drum head 112, also shown in brokenaway view, and constituting an end wall of a barrel drum of substantial capacity. The drum head 112 has an offset wall 114 bounding a circular recess 116, as well as an annular neck 118 symmetrically surrounding a longitudinal axis B—B. The neck 118 terminates in a circular open end region or mouth 120, the mouth extending in a plane which is generally parallel to that of the drum head 112, instead of being generally perpendicular thereto as in the first embodiment.

A base 122 has a circular flange 124 of complementary contour to, and seated within, the recess 116. The base 122 also has an interiorly-threaded cylindrical sleeve portion 126, as well as an annular ridge 128 at an upper axial end of the base 122. A plurality of radially-extending teeth 130 are equi-angularly arranged about the longitudinal axis B—B and bitingly engage into neck 118.

A plug 132 has a closed wall 134 spanning a hollow passage formed through sleeve portion 126. The plug 132 also has an exteriorly-threaded cylindrical portion 136 threadedly engaging the interiorly-threaded sleeve portion 126. The plug 132 further has an axially-extending non-threaded portion 138, and a radially-extending annular collar 140 which is adjacent the non-threaded portion 138. The collar 140 has outer polygonal walls 144, as best shown in FIG. 4. The plug 132 is still further provided with an insert 135 in an interior space 146 whereby the plug 132 may be adequately torqued so that the exteriorly-and interiorly-threaded portions 136, 126 will tightly engage each other. A seal 148 of rubber, plastic or analogous sealing material is mounted between, and sealingly engages, the collar 140 and the non-threaded portion 138, on the one hand, and the ridge 128 and the mouth 120, on the other hand, so as to not only resist outward leakage of the toxic hazardous materials past the threadedly-engaged interiorly- and exteriorly-threaded portions, but also to resist inward flow of ambient air into the drum.

An overcap 150 is mounted on the drum head 112, and confines the base 122, the plug 132 and the seal 148. The overcap 150 has a top wall 152 which overlies and closes the interior space 146, as well as a polygonal cap portion 154 extending downwardly from the top wall 152. The overcap 150 further has a depending annular skirt portion 156 crimped onto the neck 114. The polygonal cap portion 154 is provided with a plurality of polygonal walls 158 of complementary contour to, and seated about, the polygonal walls 144 of the collar 140 of the plug 132.

As best shown in FIG. 6, the polygonal walls 158 on the cap portion 154 of the overcap 150 serve as locking means. The polygonal walls 144 on the collar 140 of the plug 132 serve as co-acting means which cooperatively lockingly engage the polygonal walls 158. The locking interengagement between the polygonal walls 144, 158 serve to resist rotation of the plug 132 relative to the overcap 150 about the axis B-B, and positively prevent the drum seal from being compromised during shipping when the drum is acted upon by vibrations and impact forces.

It will be understood that each of the elements described above, or two or more together, also may find a useful application in other types of constructions differing from the types described above.

While the invention has been illustrated and described as embodied in leak-resistant drum seals for hazardous materials that are toxic by inhalation, it is not intended to be limited to the details shown, since various modifications and structural changes may be made without departing in any way from the spirit of the present invention. For example, the materials need not be toxic and hazardous. Also, the drums themselves need not be of substantial capacity on the order of 55 gallons, but can be of more or less capacity.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be prtected by Letters Patent is set forth in the appended claims:

1. A drum seal for resisting leaks of materials from a shipping drum, comprising:

(a) a drum head having an annular neck surrounding a longitudinal axis;

(b) a base having an interiorly-threaded portion mounted within, and axially extending along, the neck;

(c) a plug having an exteriorly-threaded portion mounted within, and threadedly engaging, the interiorly-threaded portion of the base, said plug having a radially-extending collar which is located axially adjacent the exteriorly-threaded portion;

(d) a seal mounted between, and sealingly engaging, the collar and the base to resist leakage of materials past the threadedly-engaged interiorly- and exteriorly-threaded portions;

(e) an overcap mounted on the drum head and confining the base, plug and seal; and (f) means for resisting rotation of the plug about the axis during shipping of the drum, including locking means on the overcap, and co-acting means on the collar and cooperatively lockingly engaging the locking means to resist rotation of the plug relative to the overcap.

2. The drum seal as recited in claim 1, wherein the drum head has a polygonal recess; and wherein the base has a polygonal flange of complementary contour to, and seated within, the polygonal recess.

3. The drum seal as recited in claim 2, wherein the neck has an axially-extending end region, and wherein the base has a folded lip having a fold in which the neck end region is received.

4. The drum seal as recited in claim 3; and further comprising an auxiliary seal mounted between, and sealingly engaging, the base and the end region of the neck.

5. The drum seal as recited in claim 1, wherein the overcap has a cap portion mounted on the plug, and a depending skirt portion crimped onto the neck.

6. The drum seal as recited in claim 5, wherein the cap portion has a serrated annular surface overlying and lockingly engaging another serrated annular surface on the collar.

7. The drum seal as recited in claim 1, wherein the drum head has a circular recess; and wherein the base has a circular flange of complementary contour to, and seated within, the circular recess.

8. The drum seal as recited in claim 7, wherein the neck has a radially-extending end region, and wherein the base has a radially-extending lip; and further comprising an auxiliary seal mounted between, and sealingly engaging, the lip and the neck end region.

9. The drum seal as recited in claim 7, wherein the overcap has a cap portion mounted on the plug, and a depending skirt portion crimped onto the neck.

10. The drum seal as recited in claim 9; and further comprising a further seal mounted between, and sealingly engaging, the skirt portion and the neck.

11. The drum seal as recited in claim 9, wherein the cap portion has a polygonal cylindrical wall; and wherein the collar has a polygonal outer wall of complementary contour to, and lockingly engaging, the polygonal wall of the cap portion.

* * * * *